US011719468B1

(12) United States Patent
Riley

(10) Patent No.: US 11,719,468 B1
(45) Date of Patent: Aug. 8, 2023

(54) HEAT EXCHANGE USING AQUIFER WATER

(71) Applicant: William Riley, Captiva, FL (US)

(72) Inventor: William Riley, Captiva, FL (US)

( * ) Notice: Subject to any disclaimer, the term of this patent is extended or adjusted under 35 U.S.C. 154(b) by 0 days.

(21) Appl. No.: 17/663,171

(22) Filed: May 12, 2022

(51) Int. Cl.
*F24T 10/30* (2018.01)
*F24T 10/00* (2018.01)

(52) U.S. Cl.
CPC ..... *F24T 10/30* (2018.05); *F24T 2010/56* (2018.05)

(58) Field of Classification Search
CPC .. F03B 13/06; F03B 13/08; F03G 7/04; F05B 2220/32; F05B 2220/703; F05B 2220/602; F05B 2260/422; Y02E 10/20
See application file for complete search history.

(56) References Cited

U.S. PATENT DOCUMENTS

| | | | | |
|---|---|---|---|---|
| 4,443,707 | A * | 4/1984 | Scieri | F03B 13/06 290/54 |
| 4,448,237 | A | 5/1984 | Riley | |
| 7,615,882 | B2 | 11/2009 | Riley | |
| 7,656,050 | B2 | 2/2010 | Riley | |
| 7,952,219 | B2 | 5/2011 | Riley | |
| 8,215,104 | B2 | 7/2012 | Riley | |
| 8,984,883 | B2 | 3/2015 | Riley | |
| 11,078,649 | B1 | 8/2021 | Riley | |
| 11,194,304 | B2 | 12/2021 | Riley | |
| 2005/0199537 | A1 | 9/2005 | Kluge | |
| 2008/0047326 | A1 | 2/2008 | McCann | |
| 2009/0121481 | A1 | 5/2009 | Riley | |
| 2009/0211757 | A1 | 8/2009 | Riley | |
| 2010/0077749 | A1* | 4/2010 | Riley | F24T 10/20 60/641.2 |
| 2011/0041500 | A1 | 2/2011 | Riley | |
| 2011/0233937 | A1 | 9/2011 | Riley | |
| 2012/0285539 | A1 | 11/2012 | Riley | |
| 2014/0190691 | A1 | 7/2014 | Vinegar | |
| 2014/0260246 | A1* | 9/2014 | Fisher | F03G 7/04 60/659 |
| 2015/0143806 | A1 | 5/2015 | Friesth | |

(Continued)

FOREIGN PATENT DOCUMENTS

| | | |
|---|---|---|
| WO | WO 2009/042312 | 4/2009 |
| WO | WO 2009/064630 | 5/2009 |

(Continued)

OTHER PUBLICATIONS

Wikipedia [online], "Pumped-storage hydroelectricity," Jun. 3, 2005, retrieved on Mar. 30, 2020, retrieved from URL<https://en.wikipedia.org/wiki/Pumped-storage_hydroelectricity>, 11 pages.

*Primary Examiner* — Mickey H France
(74) *Attorney, Agent, or Firm* — Fish & Richardson P.C.

(57) ABSTRACT

In a method, an electrical grid is monitored. Based on monitoring the electrical grid, it is determined that one or more criteria are satisfied at a first time. In response to determining that the one or more criteria are satisfied at the first time, water is moved from an aquifer located at a first elevation to a reservoir located at a second elevation. The first elevation is lower than the second elevation. The water is moved from the reservoir through a heat exchanger, and heat is transferred using the water. Subsequent to moving the water through the heat exchanger, the water is moved into the aquifer.

20 Claims, 8 Drawing Sheets

(56) References Cited

U.S. PATENT DOCUMENTS

| | | | | |
|---|---|---|---|---|
| 2017/0314221 | A1 | 11/2017 | Watson | |
| 2018/0078872 | A1 | 3/2018 | Riley | |
| 2019/0334412 | A1* | 10/2019 | Franck | H02K 19/365 |
| 2020/0355529 | A1 | 11/2020 | Leaders et al. | |
| 2022/0195974 | A1 | 6/2022 | Riley | |

FOREIGN PATENT DOCUMENTS

| | | |
|---|---|---|
| WO | WO 2009/105605 | 8/2009 |
| WO | WO 2009/108248 | 9/2009 |
| WO | WO 2010/037017 | 4/2010 |
| WO | WO 2012/154839 | 11/2012 |
| WO | WO 2013/163314 | 10/2013 |

* cited by examiner

HEAT EXCHANGE USING AQUIFER WATER

TECHNICAL FIELD

This disclosure relates to systems for using water from aquifers and other water bodies as a fluid in heat exchangers.

BACKGROUND

An aquifer is an underground layer of water-bearing permeable rock, rock fractures, and/or unconsolidated materials (e.g., gravel, sand, or silt) from which groundwater can be extracted. In some implementations, water can be extracted from an aquifer using a water well that extends from the earth's surface to the aquifer.

SUMMARY

In one aspect, the present disclosure describes a method. In the method, an electrical grid is monitored. Based on monitoring the electrical grid, it is determined that one or more criteria are satisfied at a first time. In response to determining that the one or more criteria are satisfied at the first time, water is moved from an aquifer located at a first elevation to a reservoir located at a second elevation. The first elevation is lower than the second elevation. The water is moved from the reservoir through a heat exchanger, and heat is transferred using the water. Subsequent to moving the water through the heat exchanger, the water is moved into the aquifer.

This and other described methods can have one or more of at least the following characteristics.

In some implementations, moving the water through the heat exchanger includes determining, based on monitoring the electrical grid, that one or more second criteria are satisfied at a second time; and in response to determining that the one or more second criteria are satisfied at the second time, moving the water from the reservoir through the heat exchanger.

In some implementations, the one or more second criteria include that use of the water in the heat exchanger is more cost-effective than use of an alternative secondary fluid in the heat exchanger or use of an alternative system to perform a heating or cooling function performed by the heat exchanger.

In some implementations, the method includes monitoring an ambient temperature at the earth's surface. Moving the water through the heat exchanger includes determining, based on monitoring the ambient temperature, that one or more second criteria are satisfied at a second time; and, in response to determining that the one or more second criteria are satisfied at the second time, moving the water from the reservoir through the heat exchanger.

In some implementations, determining that the one or more criteria are satisfied at the first time is based on monitoring the electrical grid and based on a temperature of the aquifer.

In some implementations, determining that the one or more criteria are satisfied at the first time is based on monitoring the electrical grid and based on a predicted time until the heat exchanger will be operated.

In some implementations, moving the water into the aquifer includes moving the water to a turbine generator located at a third elevation. The third elevation is lower than the second elevation and higher than the first elevation. The method includes generating electrical power using the turbine generator based on the water flowing through the turbine generator. The method includes moving the water from the turbine generator into the aquifer.

In some implementations, moving the water to the turbine generator includes moving the water from the heat exchanger to a second reservoir; determining, based on monitoring the electrical grid, that one or more second criteria are satisfied at a second time; and, in response to determining that the one or more second criteria are satisfied at the second time, moving the water from the second reservoir to the turbine generator.

In some implementations, a flow path from the aquifer to the reservoir is separate from a flow path from the second reservoir to the aquifer.

In some implementations, moving the water to the turbine generator and from the turbine generator into the aquifer includes moving the water through a conduit under the influence of gravity and without aid of a pump.

In some implementations, monitoring the electrical grid includes monitoring a dynamic price of electricity in the electrical grid, and the one or more criteria include the dynamic price being below a threshold value.

In some implementations, the method includes generating electrical power by at least one of solar power generation or wind power generation. Moving the water from the aquifer to the reservoir includes pumping the water from the aquifer to the reservoir at least partially using power generated by at least one of the solar power generation or the wind power generation.

In some implementations, the one or more criteria include a supply of electrical power generated by at least one of the solar power generation or the wind power generation being above a threshold value.

In some implementations, moving the water from the turbine generator into the aquifer includes causing the water to flow from the turbine generator to the aquifer without aid of a pump.

In some implementations, the method includes providing at least a portion of the electrical power generated using the turbine generator to the electrical grid.

Some aspects of this disclosure describe a system. The system includes an aquifer located at a first elevation; a reservoir located at a second elevation that is higher than the first elevation; one or more conduits linking the aquifer and the reservoir; one or more pumps; a heat exchanger; and a control system having one or more processors. The control system is configured to perform operations. The operations include monitoring an electrical grid; determining, based on monitoring the electrical grid, that one or more criteria are satisfied at a first time; in response to determining that the one or more criteria are satisfied at the first time, moving water from the aquifer to the reservoir using the one or more pumps; moving the water from the reservoir through the heat exchanger, including transferring heat using the water; and, subsequent to moving the water through the heat exchanger, moving the water into the aquifer.

This and other described systems can have one or more of at least the following characteristics.

In some implementations, moving the water through the heat exchanger includes determining, based on monitoring the electrical grid, that one or more second criteria are satisfied at a second time; and, in response to determining that the one or more second criteria are satisfied at the second time, moving the water from the reservoir through the heat exchanger.

In some implementations, the one or more second criteria include that use of the water in the heat exchanger is more cost-effective than use of an alternative secondary fluid in the heat exchanger or use of an alternative system to perform a heating or cooling function performed by the heat exchanger.

In some implementations, the operations include monitoring an ambient temperature at the earth's surface. Moving the water through the heat exchanger includes determining, based on monitoring the ambient temperature, that one or more second criteria are satisfied at a second time; and, in response to determining that the one or more second criteria are satisfied at the second time, moving the water from the reservoir through the heat exchanger.

In some implementations, determining that the one or more criteria are satisfied at the first time is based on monitoring the electrical grid and based on a temperature of the aquifer.

In some implementations, determining that the one or more criteria are satisfied at the first time is based on monitoring the electrical grid and based on a predicted time until the heat exchanger will be operated.

In some implementations, the system includes a turbine generator located at a third elevation. The third elevation is lower than the second elevation and higher than the first elevation. Moving the water into the aquifer includes moving the water to the turbine generator, generating electrical power using the turbine generator based on the water flowing through the turbine generator, and moving the water from the turbine generator into the aquifer.

In some implementations, the system includes a second reservoir. Moving the water to the turbine generator includes moving the water from the heat exchanger to the second reservoir; determining, based on monitoring the electrical grid, that one or more second criteria are satisfied at a second time; and, in response to determining that the one or more second criteria are satisfied at the second time, moving the water from the second reservoir to the turbine generator.

In some implementations, the one or more conduits are one or more first conduits. The system further includes one or more second conduits linking the second reservoir to the turbine generator and the turbine generator to the aquifer. The one or more second conduits are separate from the one or more first conduits.

One or more of the implementations described in this disclosure can provide various advantages. For example, some implementations according to this disclosure can exploit natural aquifers or other water bodies as suppliers of water for use in heat exchangers, reducing cost or energy consumption compared to the use of alternative secondary fluids. In some implementations, extraction of water can be timed based on an electrical grid status, a supply of electrical power produced by an ancillary power source, a predicted time until a heat exchanger will be operated, and/or another basis, improving water supply efficiency. In some implementations, use of extracted water in a heat exchanger can be timed based on an electrical grid status, a weather status, and/or another basis, improving heat exchanger efficiency. In some implementations, after use in a heat exchanger, extracted water can be provided back to its original source (e.g., an aquifer) through a turbine generator, recouping energy consumed in the water's extraction.

The details of one or more embodiments are set forth in the accompanying drawings and the description below. Other aspects, features and advantages will be apparent from the detailed description and accompanying drawings, and from the claims.

DETAILED DESCRIPTION

Figure 1A:
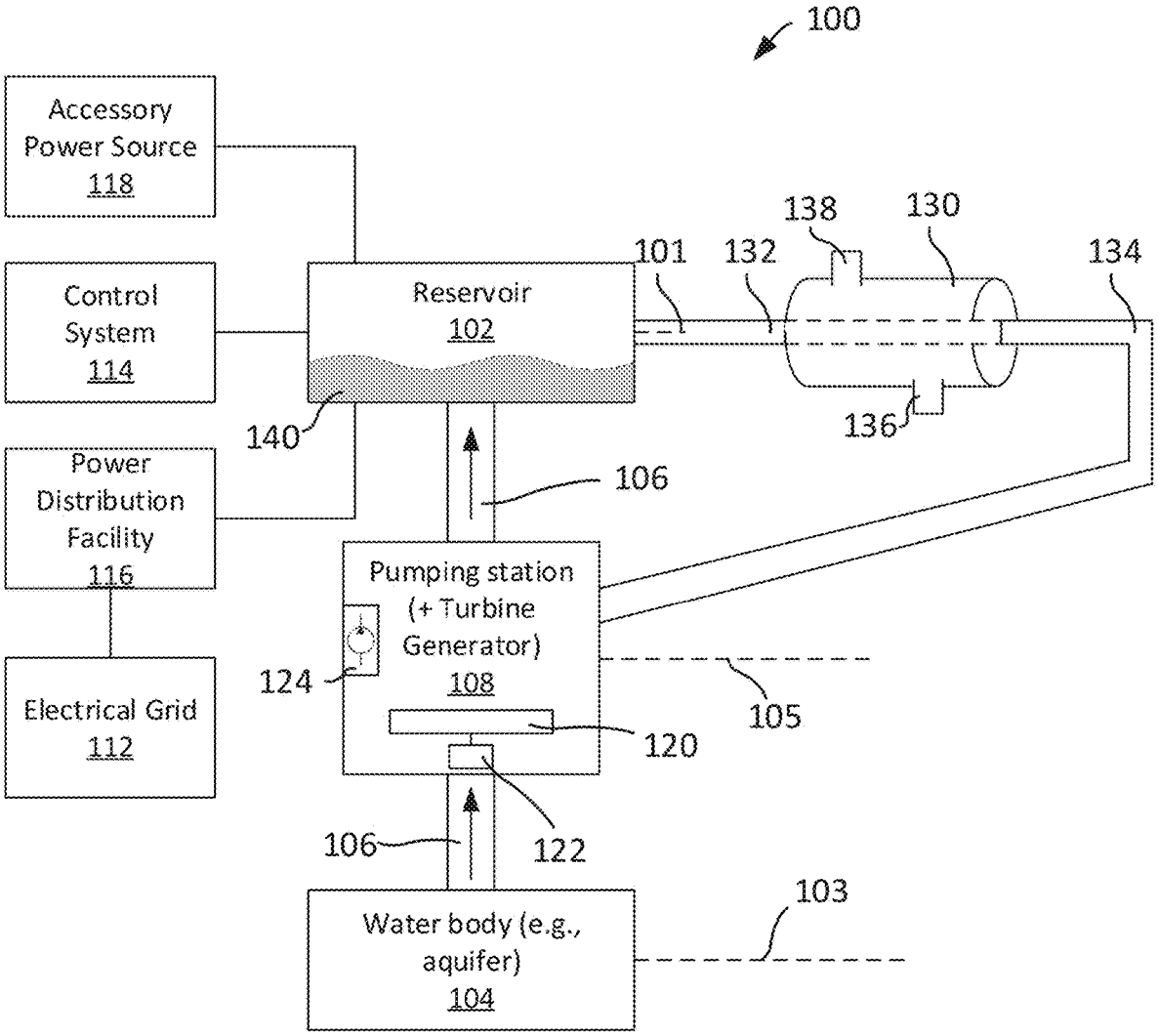
FIGS. 1A and 1B are diagrams illustrating an example of a heat exchange system.

This disclosure describes implementations of grid-adaptive heat exchange systems. Some implementations of these systems are operable to draw water from large water bodies such as aquifers, lakes, or reservoirs and to bring the water to higher elevations for subsequent use as a heat sink or heat provider in a heat exchanger. The timing of drawing the water to the higher elevations is selected based on a state of an electrical power grid, a state of an accessory power source (such as a solar or wind power source), or another factor. Accordingly, water can be drawn when it is advantageous to do so and subsequently used in a heat exchanger, in some cases displacing other, higher-cost or lower-efficiency sources. In some implementations, the water, after use in the heat exchanger, can be moved back to its original source through a turbine generator, and this operation, too, can be timed based on a grid or accessory power source state.

Heat exchangers find application in various heating and cooling systems. In a heat exchanger, heat is transferred from a first medium (e.g., a solid or a fluid) to a second medium. For example, heat can be transferred between two fluids, such as between two gases, between two liquids, or between a gas and a liquid. In some cases, the heat exchanger is configured to transfer heat from a working fluid to a secondary fluid that is initially cooler than the working fluid, in which case the secondary fluid is a heat sink. For example, in refrigeration and air-conditioner thermodynamic cycles, a gaseous refrigerant (working fluid) flows into a condenser, is placed in thermal contact with a cooler secondary fluid (e.g., air, water, or a another refrigerant), and condenses into a fluid by transferring its heat to the secondary fluid. In some cases, the heat exchanger is configured to transfer heat to the working fluid from a secondary fluid that is initially hotter than the working fluid, in which case the secondary fluid is a heat provider. For example, in some operational modes of a heat pump, air or another working fluid can be placed in thermal contact with a warmer secondary fluid, so as to gain heat and warm an interior of a building.

Provision of secondary fluids at appropriate temperatures can be expensive or energy-intensive. For example, if ambient air or water at ambient temperatures is to be used as a secondary fluid, the secondary fluid's temperature will fluctuate depending on the time of year. If the secondary fluid is to have its own temperature modified before use in a heat exchanger, that temperature modification may require electricity usage. Dynamic pricing, in which the spot price of electricity various over time to induce more or less power production from suppliers and to induce more or less demand from consumers, can exacerbate the costs associated with temperature modification of secondary fluids. That is, because times of heat exchanger use tend to overlap with times of high electrical grid usage (e.g., to heat or cool homes in a region during times of cold or hot weather), the dynamic price of electricity at that time will tend also to be high.

On the other hand, aquifers and other large water bodies tend to exhibit relatively stable temperatures year-round. For example, depending on the depth of water in an aquifer, the water temperature may vary in a relatively narrow band around the annual mean air temperature above the aquifer, with the average water temperature increasing slowly with increasing depth below the earth's surface. Accordingly, water pumped from aquifers can be used reliably as a heat sink or heat provider throughout the year. As described in this disclosure, when water pumping from the aquifer or from another large water source is timed to coincide with low dynamic prices of electricity, high electricity supply relative to electricity demand in an electrical grid, or excess electricity supply by an accessory power source, the cost of the pumping can be reduced, and accordingly the overall costs associated with heat exchanger use also can be reduced.

An example of a heat exchange system 100 is shown schematically in FIG. 1A. The heat exchange system 100 includes a reservoir 102 and a water body 104. The reservoir 102 and the water body 104 are in fluidic communication with one another via a conduit 106 extending between them. The reservoir 102 is located at a first elevation 101 that is higher than a second elevation 103 at which the water body 104 is located. For example, the first elevation 101 can be the surface of the Earth, and the second elevation 103 can be an underground (subterranean) elevation or can be a surface elevation that is lower than the first elevation 101. The water body 104 can be a lake, a river, a sea, a reservoir (e.g., an artificial reservoir), or an aquifer. Hereinafter, this disclosure refers to the water body 104 as an aquifer 104, but the characteristics of the heat exchange systems described herein can also be applied to systems that include other types of water bodies that act as water sources.

The heat exchange system 100 also includes a pumping station 108 having one or more pumps 124 configured to pump water towards the aquifer 104 (e.g., from the reservoir 102) and/or away from the aquifer 104 (e.g., towards the reservoir 102). In this example, the pumping station 108 is located in the conduit 106 at a third elevation 105 that is higher than the second elevation 103 of the aquifer 104 and lower than the first elevation 101 of the reservoir 102. However, in various implementations, pumping action can be applied from other elevations to move water from the aquifer 104 to the reservoir 102 and/or vice-versa.

In some implementations, the pumping station 108 is a combined pumping station and turbine generator. The turbine generator converts potential and/or kinetic energy into electrical power. Specifically, as water flows from a higher elevation to a lower elevation through the turbine generator (e.g., through conduit 134 as described in reference to FIG. 1B below), the turbine generator converts at least a portion of the potential and/or kinetic energy from the flowing water into electrical power. In some implementations, the turbine generator can include one or more turbine or rotor assemblies 120 located in the path of the water flowing through the turbine generator, e.g., through the conduit 134. As the flowing water passes through the turbine generator, the flowing water rotates the turbine or rotor assemblies 120. This mechanical motion can be used to actuate one or more components 122 of a dynamo (e.g., a commutator) and/or an alternator (e.g., a magnet or an armature) to produce electrical current.

In some implementations, e.g., when the pumping station 108 includes a turbine generator, the pumping and turbine functions can be combined into a joint system. For example, the pumping station 108 can be a pump-turbine or a pump-as-turbine, in which reverse operation of the turbine acts to pump water from the aquifer 104 to the reservoir 102. This implementation can be beneficial, for example, as a pre-existing installation already may have one or more pumps located in conduits extending from the surface of the earth to the aquifer 104. Thus, the pumping station 108 including a turbine generator can be implemented using some or all of those same pumps and conduits, thereby reducing the cost of implementing the heat exchange system 100. In some implementations, the one or more pumps 124 are separate from the turbine generator and/or from the one or more turbine or rotor assemblies 120. For example, the one or more pumps 124 can include dedicated positive displacement pumps and/or centrifugal pumps.

The heat exchange system 100 also includes a heat exchanger 130 in fluidic communication with the reservoir 102 via conduit 132. The heat exchanger 130 includes a working fluid input 136 and a working fluid output 138 through which a working fluid can be supplied and extracted. Inside the heat exchanger 130, the working fluid is placed in thermal communication with water from the reservoir 102 to heat or cool the working fluid. Various types of heat exchanger 130 are within the scope of this disclosure. For example, the heat exchanger 130 can be a shell and tube heat exchanger, a plate heat exchanger, a plate and shell heat exchanger, a finned heat exchanger (e.g., a plate fin heat exchanger or a finned tube heat exchanger), a phase-change heat exchanger, or any other suitable type of heat exchanger. The working fluid can be air, a gas, water, a refrigerant, or another suitable type of fluid. Fluid flow through the heat exchanger 130 can be, for example, counter-current flow, spiral flow/cross flow, or distributed vapor/spiral flow. In some implementations, one or more pumps (not shown) are operable (e.g., by control system 114) to move water from the reservoir 102 through the heat exchanger 130.

In some implementations, the heat exchange system 100 includes an accessory power source 118. The accessory power source 118 generates power separately from power generation by the turbine generator (when the turbine generator is present). For example, the accessory power source 118 can include one or more solar power systems, one or more wind power systems, one or more coal power stations, one or more gas power stations, one or more nuclear power stations, one or more hydropower systems, or a combination thereof. Power generated by the accessory power source 118 is typically provided to an electrical grid 112. However, as described below, power generated by the accessory power source 118 sometimes can be used to perform one or more functions of the heat exchange system 100, including powering the control system 114, powering the pumps 124 that move water from the aquifer 104 to the reservoir 102, and/or powering other pumps that move water through the heat exchange system. When the accessory power source 118 includes a source of renewable energy such as solar power, wind power, hydropower, or a combination thereof, the accessory power source 118 can be referred to as a renewable energy generation system.

The heat exchange system 100 is connected to the electrical grid 112 by a power distribution facility 116. The power distribution facility 116 can include, for example, one or more electrical transformers to convert electrical power generated by the accessory power source 118 and/or the turbine generator to a suitable current and voltage for transmission, and/or one or more electrical transmission lines to relay the electrical power to a remote entity. The electrical grid 112 to which the power distribution facility 116 is interconnected can be a general power grid (e.g., a municipal or regional power grid) to supply electrical power to one or more consumers (e.g., households, businesses, etc.) across a particular area.

A control system 114 controls operations of the heat exchange system 100. For example, the control system 114 can control movement of water between the reservoir 102, the aquifer 104, and the heat exchanger 130 (e.g., by controlling pumps (e.g., pumps 124) and fluid valves associated with the conduits 106, 132, and 134). The control system 114 also can monitor the electrical grid 112, for example, through the power distribution facility 116 and/or through a network connection to receive data indicative of electrical grid 112 parameters such as supply, demand, and dynamic power price, and can move water accordingly, as described in more detail below. The control system 114 can include one or more computer systems on-site (e.g., in proximity to the reservoir 102, accessory power source 118, heat exchanger 130 and/or power distribution facility 116), one or more remote computing systems such as remote servers communicatively coupled to other portions of the heat exchange system 100 (e.g., a cloud computing system), or a combination thereof.

The conduits 106, 132, and 134 are configured to convey fluid from one location to another. In some implementations, the conduits 106, 132, and/or 134 include one or more pipes, tubes, and/or channels for carrying fluid. As an example, the conduits 106 and/or 134 can include one or more pipes encasing one or more wellbores extending between the reservoir 102 and the aquifer 104 and/or between the heat exchanger 130 and the aquifer 104.

As shown in FIG. 1A, during a first phase of operation of the heat exchange system 100, the control system 114 controls the pumps 124 such that water is moved up from the aquifer 104 to the reservoir 102, e.g., via the conduit 106 extending between them. The reservoir 102 stores water 140 until a second phase of operation. The reservoir 102 can have various forms in different implementations. In some implementations, the reservoir 102 is an artificial reservoir such as an excavated depression that holds water. In some implementations, the reservoir 102 includes a natural body of water, such as an ocean, a lake, or a river (e.g., a dammed portion of a river). In some cases, a freshwater source for the reservoir 102 is preferable, in order to reduce transfer of salt into the aquifer 104. However, some implementations according to this disclosure can include a desalination facility, e.g., a desalination facility integrated into the reservoir 102. Examples of desalination facilities for aquifer-based hydroelectricity generation can be found in U.S. Pat. No. 11,078,649, which is incorporated by reference herein in its entirety.

The aquifer 104 is an underground layer of water-bearing permeable rock, rock fractures, and/or unconsolidated materials (e.g., gravel, sand, or silt) from which groundwater can be extracted. In some implementations, the aquifer 104 is a naturally occurring formation (e.g., a naturally occurring formation below the surface of the earth, with water naturally deposited in the formation).

In some implementations, to improve the efficiency of water extraction, transfer of water from the aquifer 104 to the reservoir 102 is performed when one or more criteria (sometimes referred to as "first criteria") are satisfied. These criteria can be related to the electrical grid 112 to which the heat exchange system 100 is connected. Because transfer of water to the reservoir 102 is associated with power consumption by the pumps 124, it can be advantageous to transfer water at times other than when the water is to be used in the heat exchanger 130. Instead, water can be transferred when it is financially or otherwise efficient to operate the pumps 124, and the water can be used later in the heat exchanger 130. For example, water can be transferred during times of off-peak power or during times of solar power supply excess.

In some implementations, the energy used to operate the pumps 124 is generated at least in part by the accessory power source 118. In some implementations, the energy used to operate the pumps 124 is obtained at least in part from the electrical grid 112. As power supply and demand ebb and flow in the electrical grid 112, and/or as power generated by the accessory power source 118 increases and decreases (e.g., absolutely or in comparison to demand from the electrical grid 112), operation of the pump 124 is more or less favorable, and one or more first criteria dictate when water is to be moved from the aquifer 104 to the reservoir 102 for storage in the reservoir 102 and subsequent use in the heat exchanger 130.

In some implementations, the one or more first criteria for storage of water (transfer of water from the aquifer 104 to the reservoir 102) include a price condition. The electrical grid 112 is monitored (e.g., a market, exchange, or clearing house of the electrical grid 112) to determine a dynamic price (spot price) of power on the electrical grid 112. If the dynamic price is low (e.g., is less than a threshold value), then water can be transferred from the aquifer 104 to the reservoir 102, without necessarily being used at that time in the heat exchanger 130. For example, during the summer, the dynamic price tends to be low at night, while water will be needed in the heat exchanger during the day (e.g., for cooling purposes). Accordingly, water can be transferred from the aquifer 104 to the reservoir 102 at night (e.g., using power drawn from the electrical grid 112), and the water can be transferred from the reservoir 102 to the heat exchanger 130 and used in the heat exchanger 130 during the day. In some implementations, water can be transferred from the aquifer 104 to the reservoir 102 during the day (e.g., mid-afternoon), to coincide with times of solar excess.

In some implementations, power is generated by the accessory power source 118, and it is determined whether to sell the generated power on the electrical grid 112 or use the power to transfer water from the aquifer 104 to the reservoir 102. For example, in some implementations, if the dynamic price is high (e.g., higher than a threshold value), then power generated by the accessory power source 118 is provided to the electrical grid 112. However, if the dynamic price is low (e.g., lower than a threshold value), power generated by the accessory power source 118 is used to power the pumps 124 to transfer water from the aquifer 104 to the reservoir 102. In some implementations, if a supply of electrical power produced by the accessory power source 118 is above a threshold value (e.g., representing an excess of generated power), power can be provided from the accessory power source to the pumps 124 to move water from the aquifer 104 to the reservoir 102.

In some implementations, the one or more first criteria for water storage (transfer of water from the aquifer 104 to the reservoir 102) include a supply/demand condition. Power supply and power demand in the electrical grid 112 are monitored over a period of time. When the supply and demand satisfy a relative condition (e.g., when the supply exceeds the demand), power (e.g., power generated by the accessory power source 118) is used to power the pumps 124 to transfer water from the aquifer 104 to the reservoir 102 for later use in the heat exchanger 130.

For instance, a threshold difference between supply and demand can be ten (10) units of power. When the demand for electrical power is one hundred and five (105) units and the supply of electrical power is one hundred and ten (110) units, the heat exchange system 100 can refrain from moving water from the aquifer 104 to the reservoir 102. However, when the demand for electrical power is one hundred and five (105) units and the supply of electrical power is one hundred and twenty five (125) units, the heat exchange system 100 can move water from the reservoir 102 to the reservoir 102.

In some implementations, the threshold level (e.g., of a supply/demand difference or of a dynamic price) can be selected empirically (e.g., selected by an operator of the heat exchange system 100 based on experiment or tests). In some implementations, the threshold level can be an absolute value (e.g., expressed in absolute units of power). In some implementations, the threshold level can be a relative value (e.g., expressed as a particular percentage of the demand of electrical power or the supply of electrical power).

In some implementations, the control system 114 can determine, based on historical usage information regarding the electrical grid 112, that the dynamic price of electricity is typically low during certain times of the day (e.g., for a given time of the year). Based on this information, the control system 114 can control the heat exchange system 100 to transfer water from the aquifer 104 to the reservoir 102 at the identified times of day, so that the water can be stored at low cost and later used in the heat exchanger 130.

In some implementations, the one or more first criteria for water storage include a timing condition based on monitoring and/or predicting use of the heat exchanger 130. Based on analysis of past use of the heat exchanger 130 and/or other heat exchangers (in some cases, in combination with other data), it can be predicted that the heat exchanger 130 will be used at a future time. For example, data analysis can indicate that the heat exchanger 130 will be used at certain time of a day, based on past use of the heat exchanger 130 and/or based on predicted temperatures during the day. Based on this prediction, in some implementations the control system 114 can transfer water from the aquifer 104 to the reservoir 102 in advance of the future time, even if the transfer occurs when an electrical grid condition (e.g., a supply/demand condition or a dynamic pricing condition) is not satisfied, so that water is available for use at the future time.

In some implementations, the one or more first criteria for water storage include a joint timing condition based both on the electrical grid and on predicted use of the heat exchanger 130. The joint timing condition represents a balancing between (i) storing water when the dynamic price of electricity is low and/or when electrical grid supply outstrips demand, and (ii) ensuring that water is available for use in the heat exchanger 130 when needed. In some implementations, the joint timing condition is based on a threshold value that varies based on a remaining time before the heat exchanger 130 is predicted to be used. For example, a threshold dynamic price (below which the control system 114 determines to store water) can increase with decreasing remaining time before the heat exchanger 130 is predicted to be used, representing a loosening of price conditions as the future requirement for water grows more urgent.

In some implementations, the one or more first criteria for storage of water include a condition at least partially based on a measured or predicted temperature of water in the aquifer 104. For example, when the water is to be used as a heat sink, the heat sinking will be more effective when the water is colder. Similarly, when the water is to be used as a hot provider, the heat provision will be more effective when the water is warmer. Accordingly, in some implementations, it is determined whether the temperature of the water in the aquifer 104 satisfies a condition (e.g., is greater than or less than a threshold value) and, if so, water is moved from the aquifer 104 to the reservoir 102 for storage and subsequent use in the heat exchanger 130. The temperature can be measured (e.g., using a sensor in or thermally coupled to water in the aquifer 104) and/or the temperature can be predicted (e.g., based on a stored function that outputs a predicted temperature as a function of one or more variables, such as time of year and ambient air temperature.

In some implementations, the one or more first criteria for storage of water include another combination of the aforementioned conditions/dependencies. For example, a function of the dynamic price, the difference between supply and demand, a time-dependent predicted dynamic price or supply/demand state, and/or a time remaining before future use of the heat exchanger 130 can be determined (e.g., a weighted combination of these values), and the function can be tested against a condition to determine whether to transfer water from the aquifer 104 to the reservoir 102.

Figure 1B:
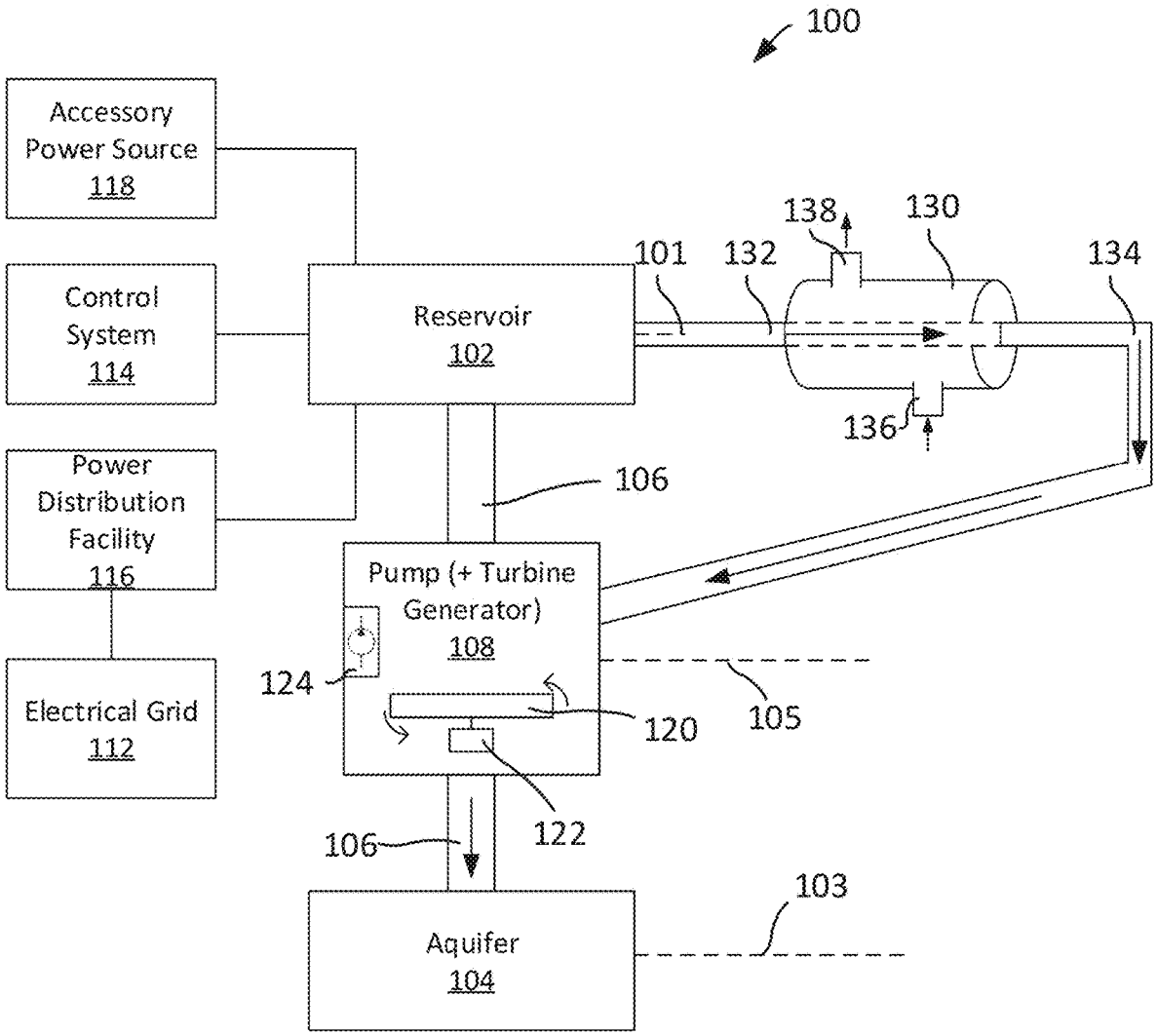

During a second phase of operation of the heat exchange system 100, as shown in FIG. 1B, the control system 114 controls the heat exchange system 100 to move previously-stored water from the reservoir 102 to the heat exchanger 130 through conduit 132. In the heat exchanger 130, a working fluid flow into the working fluid input 136 and interacts thermally with the water, drawing heat from the water or supplying heat to the water. In the example of FIGS. 1A-1B, the working fluid then flows out through the working fluid output 138, and the water flows through conduit 134 back to the aquifer 104. In some implementations (as described below in reference to FIGS. 3-5), the water can be stored in another reservoir before being moved back to the aquifer 104, in order to satisfy one or more conditions for return of the water.

In some implementations, use of the water in the heat exchanger 130 (e.g., movement of the water from the reservoir 102 to the heat exchanger 130) is performed by the control system 114 based on one or more second criteria being satisfied. For example, in some implementations, the reservoir 102 is the primary or only source of secondary fluid for the heat exchanger 130, and the control system 114 moves water from the reservoir 102 to the heat exchanger 130 when the control system 114 determines that the heat exchanger 130 is to be operated. However, in some implementations, alternative sources of secondary fluid for the heat exchanger 130 exist, and/or an alternative system can be used instead of the heat exchanger 130 to perform heating/cooling functions, and the one or more other second criteria can determine when the water from the reservoir 102 is used in the heat exchanger 130.

For example, in some implementations, use of an alternate secondary fluid or use of an alternative system is associated with power consumption. When the dynamic price of electricity is less than or equal to a threshold value, use of the alternate secondary fluid or alternative system can be advantageous compared to use of water from the reservoir 102, e.g., can provide more effective and/or cost-effective heating/cooling. However, when the dynamic price is more than the threshold value, it becomes more efficient to use the water from the reservoir 102 in the heat exchanger 130, and, accordingly, the control system 114 moves water from the reservoir 102 to the heat exchanger 130. Accordingly, use of water from the reservoir 102 can displace alternative heating/cooling solutions during times when such displacement is efficient. In some implementations, a second criteria for moving water from the reservoir 102 to the heat exchanger 130 can instead or additionally be based on one or more other factors, such as weather (e.g., current ambient temperature at the earth's surface). For example, when the temperature is above or below a threshold temperature, the control system 114 can move water from the reservoir 102 to the heat exchanger 130, and/or a value of a function of the temperature and the dynamic price of electricity can be calculated, and the value can be compared to a threshold value to determine whether to move water from the reservoir 102 to the heat exchanger 130. Moreover, in various implementations, any one or more of the first criteria described above or the third criteria described below can be used to determine when to move water from the reservoir 102 to the heat exchanger 130.

In some implementations, when the water flows back to the aquifer 104, the potential energy of the water is converted into electrical power using a turbine generator. For example, as shown in FIG. 1B, when the turbine generator is integrated into pumping station 108, the water can be moved back to the pumping station 108 (in this example, through conduit 134) For example, the control system 114 can open valves that regulate flow through the conduits 132 and 134, to allow water to flow from the reservoir 102 to the aquifer 104 at least partially by force of gravity. As the water flows, the turbine or rotor assemblies 120 are rotated to generate power that can be transferred at least partially to the electrical grid 112 via the power distribution facility 116. In some implementations, the water is allowed to flow at least partially under the influence of gravity and without the aid of pumps. For example, the water can flow from the turbine generator (e.g., a turbine generator included in a pumping station, or another turbine generator included in some implementations) to the aquifer 104 without aid of a pump, and/or the water can flow to the turbine generator (e.g., from the surface of the earth) without aid of a pump and from the turbine generator to the aquifer without aid of a pump. Reducing or eliminating the use of pumps on the water's return path can improve the overall efficiency of power generation by reducing power that must be spent in order to facilitate power generation using the turbine generator.

At least a portion of the electrical power generated by the turbine generator is provided to the power distribution facility 116. Further, at least a portion of that electrical power can be provided to the electrical grid 112 for use. In some implementations, all or substantially all of the electrical power generated by the turbine generator can be provided to the electrical grid 112. In some implementations, some of the electrical power generated by the turbine generator can be used by the heat exchange system 100 to support its operation (e.g., to power the control system 114, power distribution facility 116, and/or heat exchanger 130). Because use of the heat exchanger 130 often (though not always) coincides with periods of high dynamic price and/or high demand for electricity relative to supply, performing power generation in conjunction with (e.g., immediately after) use of the water in the heat exchanger 130 can result in obtaining high prices for electricity supplied to the electrical grid 112 and/or can help balance the electrical grid 112.

In implementations that include a turbine generator, the water is transferred in a "round trip" between the aquifer and the earth's surface, so that the primary energy loss associated with water transport is pump/turbine loss. This loss can be offset financially by timing water extraction and, in some implementations, water return based on electrical grid and/or other conditions, as described throughout this disclosure.

When the heat exchange system 100 is operated year-round, water from the aquifer 104 may be used for cooling during part of the year and for heating during another part of the year, so that there is little net effect on the temperature on the aquifer 104. Even in cases where heat transfer to/from the aquifer 104 is net positive or negative, the size of the aquifer 104 and the aquifer's thermal coupling to its surrounding environment can mean that use of water in the heat exchanger 130 does not appreciably affect the aquifer's temperature over time.

In some implementations, the turbine generator (whether included in the pumping station or not, as described below in reference to other implementations) is disposed at an elevation near the aquifer 104, e.g., at least 75% of the way from the reservoir 102 to the aquifer 104. This implementation can be useful, for example, as it allows transferred water to acquire a relatively large amount of kinetic energy (e.g., due to its descent down the conduit 134), which may increase the amount of electrical power that can be generated by the turbine generator.

Although particular configurations of the heat exchange system 100 are shown in FIGS. 1A and 1B, these are merely illustrative examples. In practice, the heat exchange system 100 can have different arrangements of components, depending on the implementation. Further, in practice, the heat exchange system 100 can include more than one of, some, or all, of the described components. In some cases, one or more of the described components may be omitted.

Figure 2:
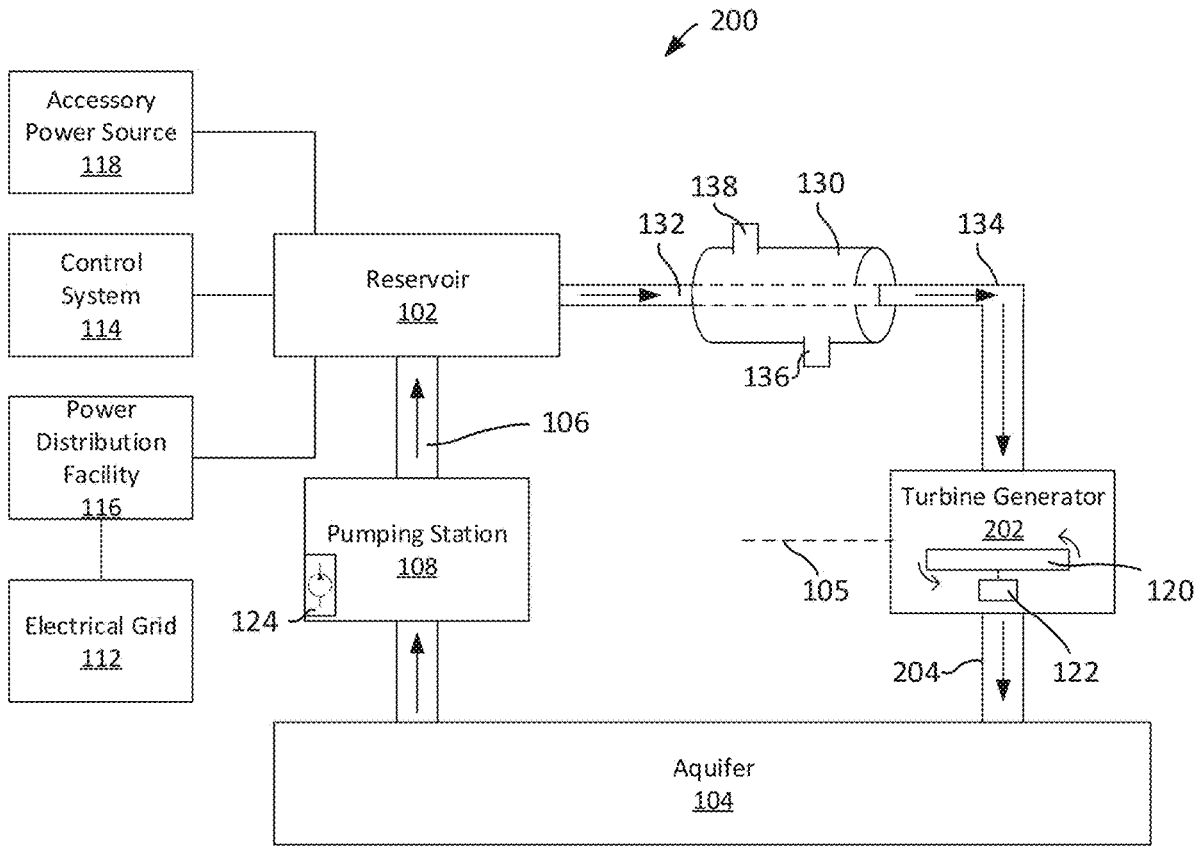
FIG. 2 is a diagram illustrating an example of a heat exchange system.

For example, although FIGS. 1A-1B show a pumping station 108 that, in some implementations, can include a turbine generator, in some implementations pumping and power generation functions are not co-located. As shown in FIG. 2, heat exchange system 200 includes a pumping station 108 operable to pump water from the aquifer 104 to the reservoir 102. After passing through the heat exchanger 130, the water can be moved through conduit 134 to turbine generator 202 located at elevation 105. The turbine generator 202 can have the characteristics described for the turbine generator included in some implementations of the pumping station 108 as described in reference to FIGS. 1A-1B. Flow of the water generates power in the turbine generator 202, and the water is returned to the aquifer 104 through conduit 204. This arrangement can simplify component design by allowing the turbine generator 202 and pumping station 108 to be designed and configured specifically for one-way flow of water. Each of the other components shown in FIG. 2 can operate in a manner similar to the corresponding components shown in FIGS. 1A-1B.

Heat exchange systems 100 and 200 operate based on at least a first criteria that determines when water is moved from the aquifer 104 to the reservoir 102 in a first phase of operation. Some implementations of the heat exchange systems 100 and 200 operate based on a second criteria that determines when water is moved from the reservoir 102 to the heat exchanger 130 and back to the aquifer 104 in a second phase of operation. In addition, some implementations of heat exchange systems operate based on a third criteria (instead of or in addition to the second criteria) that determines when, in a third phase of operation, water is moved back to the aquifer 104 after the water has been used in the heat exchanger 130. In combination with a turbine generator, this third criteria can provide power generation that is well-timed based on a state of the electrical grid 112 and/or the accessory power source 118.

Figure 3:
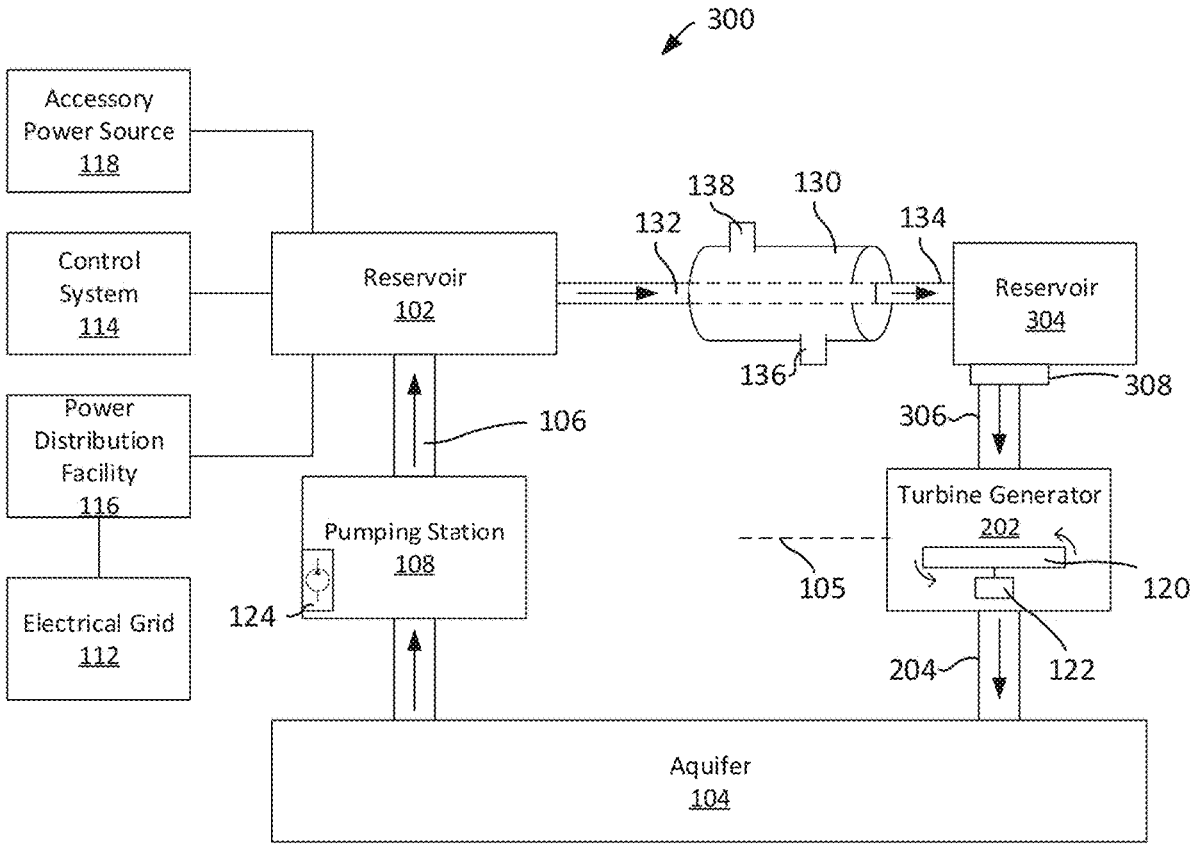
FIG. 3 is a diagram illustrating an example of a heat exchange system.

For example, as shown in FIG. 3, heat exchange system 300 includes, in addition to reservoir 102, a second reservoir 304. Reservoir 304 can have any or all of the characteristics described in reference to reservoir 102, except that reservoir 304 is positioned on the flow path of water after (instead of before) the heat exchanger 130. The control system 114 is configured to control water flow separately (i) from reservoir 102 to reservoir 304 through the heat exchanger 130, and (ii) from reservoir 304 to aquifer 104 through the turbine generator 202 to generate electricity, e.g., by opening/closing suitable valves and/or by operating pumps.

After use in the heat exchanger 130, water can be stored in the reservoir 304 until one or more third criteria that determine when water is to be moved from reservoir 304 to aquifer 104 are satisfied. These third criteria can be understood, in some implementations, as the converse of the first criteria for moving water from aquifer 104 to reservoir 102. Generation of electrical power using the turbine generator 202 can be performed selectively at specific times to meet the electrical demand on the electrical grid 112. For example, electrical power can be generated using the turbine generator 202 selectively during times of high or peak demand, and not generated, or generated at a lower level, during times of low demand. As another example, electrical power can be generated using the turbine generator 202 selectively during times of low supply (e.g., when the supply of power is unable to meet the demand). This implementation can be useful, for example, as it allows the electrical grid 112 to provide electrical power reliably to each of its users, despite fluctuations in demand over time. This also can be useful, for example, as it enables electrical power to be generated and delivered more efficiently (e.g., by reducing the storage of excess electrical power during times of low demand, which may be electrically inefficient due to power losses during the storage process). As another example, electrical power can be generated using the turbine generator 202 selectively based on the dynamic price of electricity on the electrical grid, so that the generated electrical power can be sold on the electrical grid 112 for a sufficiently high price.

In some implementations, the control system 114 controls the heat exchange system 300 to generate electrical power using the turbine generator 202 selectively to mitigate the effects of a temporal displacement between supply and demand due to the electrical grid's reliance on solar power. For example, the electrical grid's supply of solar power typically peaks during times of intense sunlight (e.g., during the afternoon). However, demand of electrical power often peaks during a different time of day when the supply of solar power has diminished (e.g., during the early evening). The heat exchange system 300 can generate electrical power using the turbine generator 202 selectively (e.g., when the supply of solar power is diminished) to supplement the electrical grid's supply.

The control system 114 determines, based on monitoring of the electrical grid 112, that one or more third criteria have been met (e.g., indicating that power is to be generated using the water in the reservoir 304). In response, the control system 114 causes the water to flow from the reservoir 304, through the turbine generator 202, and into the aquifer 104 (e.g., through the conduits 306 and 204 extending between them). In some implementations, this can be performed, at least in part, by releasing water through a valve 308 in fluidic communication between the reservoir 304 and the conduit 306, and by allowing the water to flow through the turbine generator 202 and into the aquifer 104 predominantly or entirely under the influence of gravity.

In practice, various criteria can be used to determine when the heat exchange system 300 is to generate electrical power using the turbine generator 202. As an example, in some implementations, the control system 114 can determine a demand for electrical power on the electrical grid 1112 over a period of time (e.g., during a particular measurement interval), and determine a supply of electrical power on the electrical grid 112 over the period of time (e.g., an amount of electrical power available to meet the demand). If the demand for electrical power exceeds the supply of electrical power, the heat exchange system 100 can move water from the reservoir 304, through the turbine generator 202, and into the aquifer 104 to generate electrical power. The generated electrical power can be provided to the electrical grid 112 to meet the demand.

As another example, in some implementations, the control system 114 can determine that the difference between the demand for electrical power on the electrical grid 112 and the supply for electrical power on the control system 114 is less than a threshold level. In response, the heat exchange system 100 can move water from the reservoir 304, through the turbine generator 202, and into the aquifer 104 to generate electrical power. The generated electrical power can be provided to the electrical grid 112 for distribution. This implementation can be useful, for example, as it allows the heat exchange system 300 to provide extra electrical power to the electrical grid 112 when demand is nearing the supply level (e.g., to reduce the risk of demand exceeding supply due to a subsequent spike in demand and/or a reduction in supply).

For instance, the threshold level can be ten (10) units of power. When the demand for electrical power is one hundred (100) units and the supply for electrical power is one hundred and twenty (120) units, the heat exchange system 300 can refrain from moving water from the reservoir 304, through the turbine generator 202, and into the aquifer 104 (e.g., by closing the valve 308). However, when the demand for electrical power is one hundred and fifteen (115) units and the supply of electrical power is one hundred and twenty (120) units, the heat exchange system 300 can move water from the reservoir 304, through the turbine generator 202, and into the aquifer 104 to generate electrical power (e.g., by opening the valve 308).

In some implementations, the threshold level can be selected empirically (e.g., selected by an operator of the heat exchange system 300 based on experiment or tests). In some implementations, the threshold level can be an absolute value (e.g., expressed in absolute units of power). In some implementations, the threshold level can be a relative value (e.g., expressed as a particular percentage of the demand of electrical power or the supply of electrical power).

As another example, in some implementations, the control system 114 can determine that a price condition of a dynamic power price on the electrical grid 112 is satisfied. For example, the price condition can be that the dynamic price is above a threshold value. In response, the control system 114 causes water to flow from the reservoir 304, through the turbine generator 202, and into the aquifer 104 to generate electrical power.

Implementations that include separate inflow and outflow paths for the water (such as FIG. 3's conduit 106 and conduits 204/306, respectively), with a pumping station on the inflow path and a turbine generator on the outflow path, can be advantageous in some cases, because thermal exchange between outflowing water and inflowing water (e.g., via heat stored in pipes or other components) can be reduced or eliminated. This feature can provide for more stable temperatures of the water provided into the heat exchanger 130 and, accordingly, more effective heat transfer in the heat exchanger 130.

Figure 4:
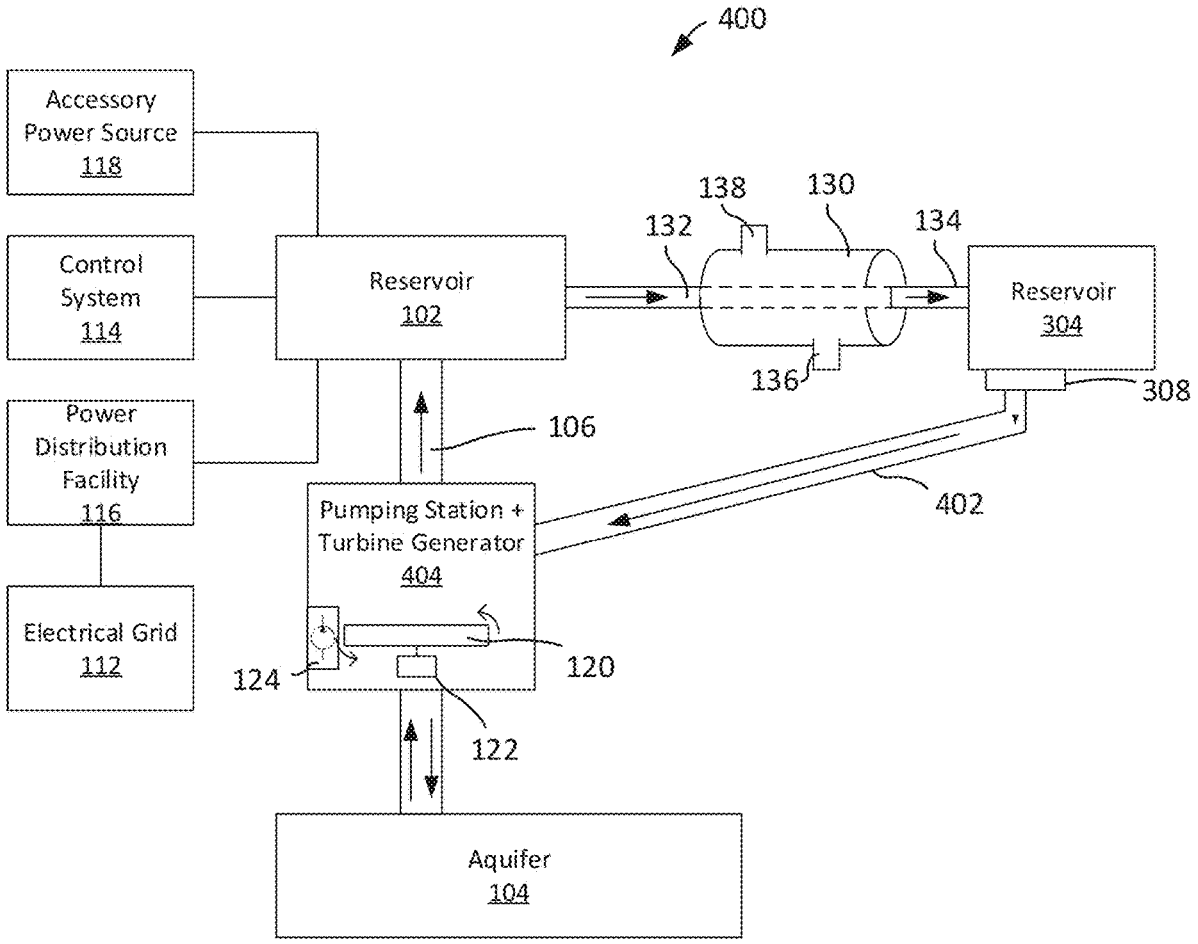
FIG. 4 is a diagram illustrating an example of a heat exchange system.

FIG. 4 shows another example of a heat exchange system 400. This example system includes a combined pumping station and turbine generator 404, as described above for some implementations of pumping station 108. For example, the combined pumping station and turbine generator 404 can include a pump-turbine or a pump-as-turbine. In a first phase of operation, pumps 124 are operated to draw water from the aquifer 104 to reservoir 102 in response to a determination that one or more first criteria are satisfied. In a second phase of operation (in some implementations, in response to a determination that one or more second criteria are satisfied), water is moved from reservoir 102 through heat exchanger 130 to reservoir 304, the water being used in the heat exchanger 130 to supply or sink heat. In a third phase of operation, in response to a determination that one or more third criteria are satisfied, water is moved from reservoir 304 to the combined pumping station and turbine generator 404 to generate electricity (e.g., by opening valve 308), and the water then is moved into the aquifer 104.

Figure 5:
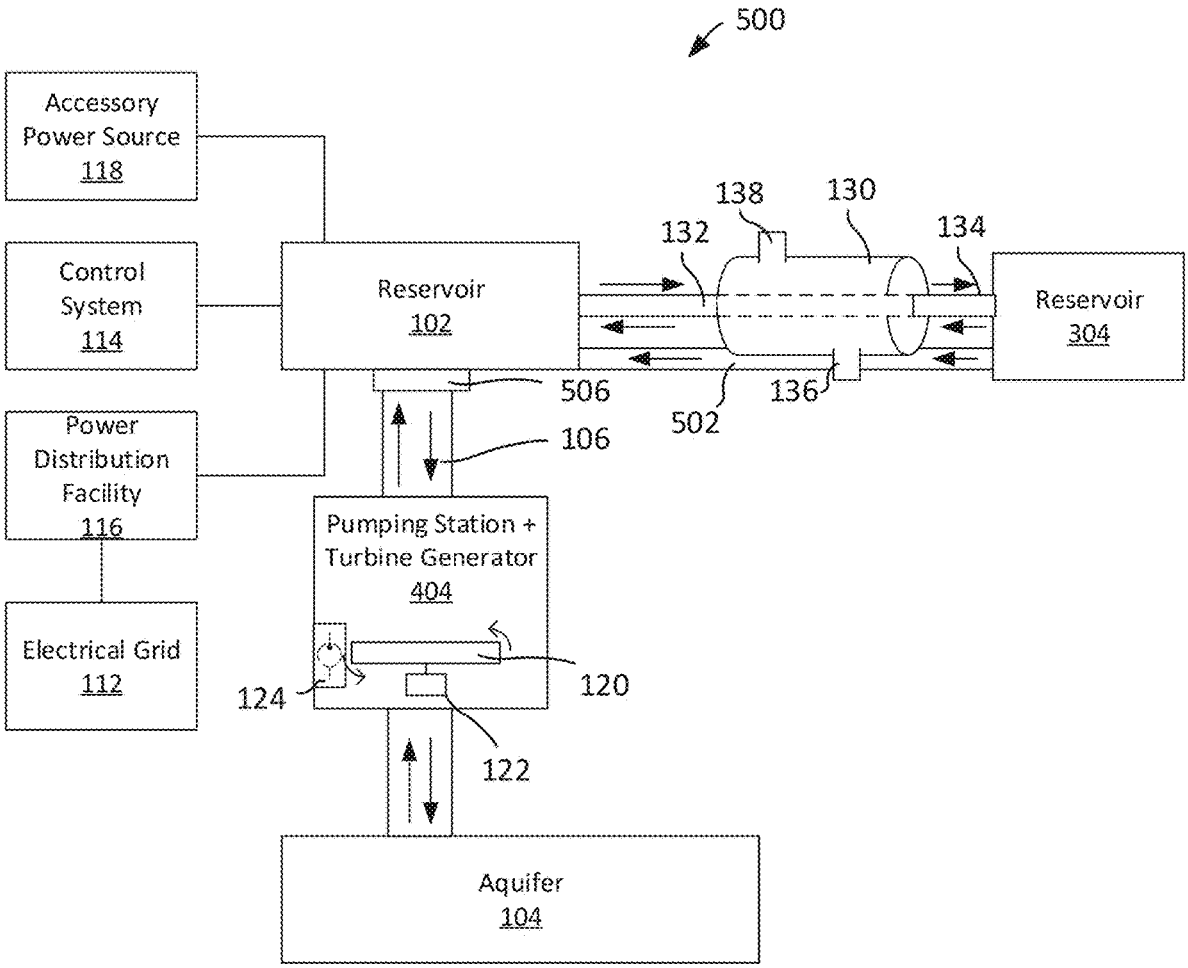
FIG. 5 is a diagram illustrating an example of a heat exchange system.

FIG. 5 shows another example of a heat exchange system 500. This example system includes a reservoir 102 and a reservoir 304, as described in reference to FIGS. 3-4, for three phases of operation. However, in this example, in the third phase of operation, water is moved from reservoir 304 back to reservoir 102, e.g., through conduits 132 and 134 and through heat exchange 130. In some implementations, water can instead, or additionally, be moved from reservoir 304 to reservoir 102 through a conduit that bypasses the heat exchanger 130, e.g., conduit 502, which can prevent operation of the heat exchanger 130 from having to accommodate back-flow of water. From reservoir 102, water is moved back to the aquifer 104, e.g., by opening valve 506. By using conduit 106 for both flow directions of the water, system cost can be reduced, upkeep can be simplified, and reliability can be increased, because only one fluid flow path from ground level to the aquifer 104 is required. And the presence of reservoir 304 allows water to be stored in reservoir 304 without mixing immediately with water in reservoir 102, so that heat exchange between water directly from the aquifer 104 and water that has passed through the heat exchanger 130 can be reduced. This feature can improve the effectiveness of heat exchange in the heat exchanger 130, because water can be provided into the heat exchanger 130 substantially at the temperature at which the water is stored in the aquifer 104. Flow of the water from reservoir 102 to reservoir 304 and/or from reservoir 304 to reservoir 102 can be caused by operation of pumps and/or valves by the control system 114.

Variations of the described fluid flow topologies are also within the scope of this disclosure. For example, in some implementations multiple pumping stations and/or multiple turbine generators can be included, e.g., in fluidic communication with separate conduits between ground level and the aquifer 104 and/or in fluidic communication with shared conduits between ground level and the aquifer 104. In some implementations, water can be drawn from and/or returned to multiple aquifers. The underground portions (e.g., pumping stations, turbine generators, aquifers, and/or conduits between those element and reservoirs) of implementations with multiple pumping stations, turbine generators, and/or aquifers can be arranged as described in reference to FIGS. 3-5 of U.S. Pat. No. 11,078,649, the entire contents of which are incorporated herein by reference.

Other first criteria, second criteria, and third criteria for storage of water (transfer from aquifer to reservoir), use of water in a heat exchanger, or transfer of water from reservoir to aquifer to generate power, respectively, are also within the scope of this disclosure. For example, in some implementations, the control system 114 monitors a supply of electrical power to the electrical grid 112 from the accessory power source 118. If the supply of electrical power from the accessory power source 118 increases above a first threshold level, in response, water can be pumped from the aquifer 104 to the reservoir 102 using at least some of the power generated by the accessory power source 118 (e.g., using a difference in power between the amount of power generated by the accessory power source 118 and the first threshold level). This implementation can be useful, for example, in reducing oversupply of electrical power to the electrical grid 112. As another example, in some implementations, if the supply of electrical power from the accessory power source 118 decreases below a second threshold level, in response, the heat exchange system 100 can move water from the reservoir 302, through the turbine generator, and into the aquifer 104 to generate electrical power. The generated electrical power can be provided to the electrical grid 112 for distribution and/or to components of the heat exchange system to power this components. This can be useful, for example, in mitigating the effects of mismatch between supply and demand due to the electrical grid's reliance on solar power and/or other power generated by the accessory power source 118. In some implementations, the first threshold level and/or the second threshold level can be determined empirically (e.g., selected by an operator of the heat exchange system 100 based on experiment or tests). Alternatively, the threshold levels can be determined in another manner, e.g., in a machine learning process that is trained to optimize one or more efficiency metrics.

Figure 6:
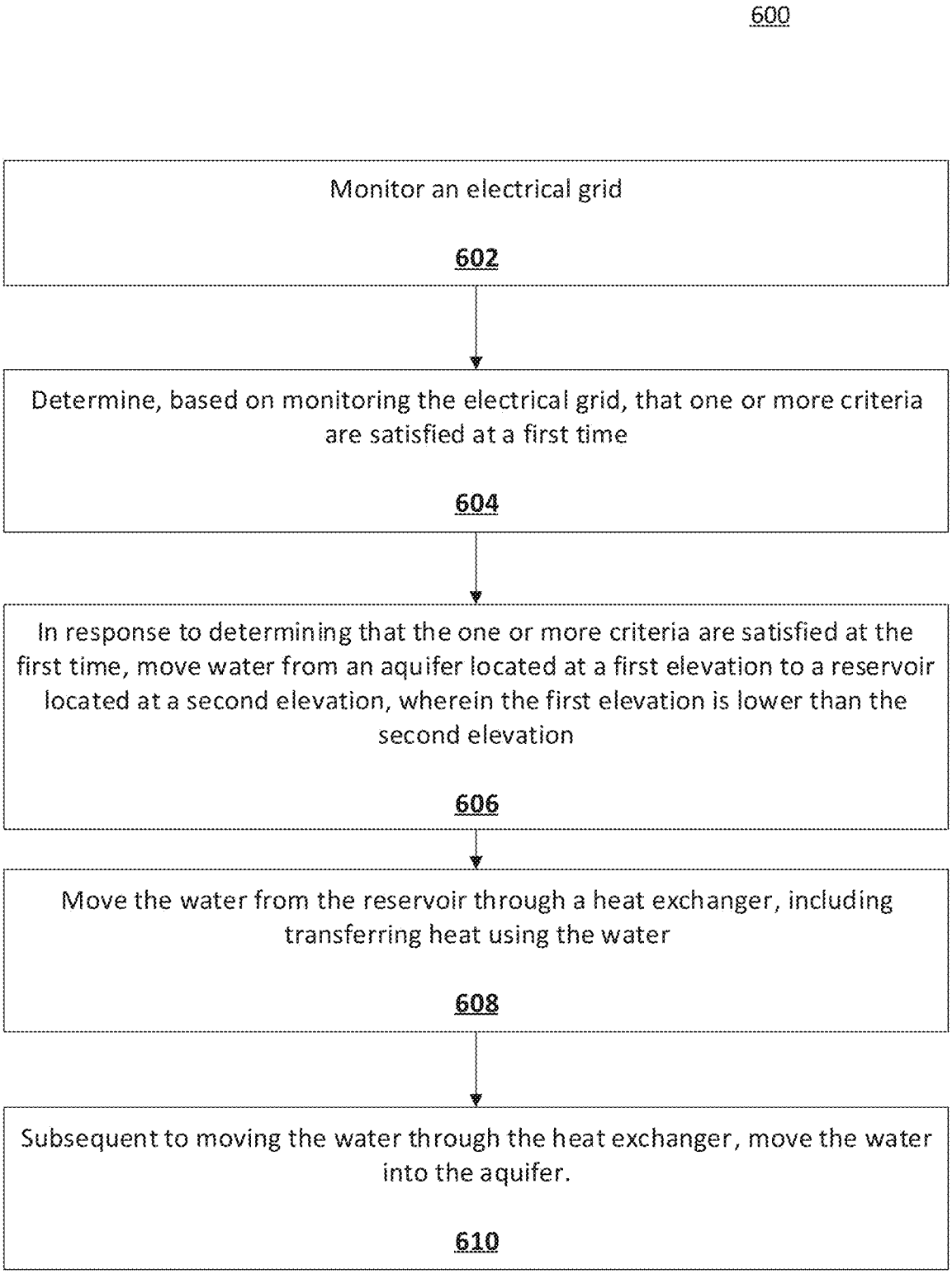
FIG. 6 is a diagram illustrating an example of a heat exchange process.

FIG. 6 shows an example process 600 that can be performed according to some implementations of this disclosure, e.g., by a control system such as control system 114. In the process 600, an electrical grid is monitored (602). It is determined, based on monitoring the electrical grid, that one or more criteria are satisfied at a first time (604). For example, the one or more criteria can be based on a dynamic price of electricity in the electrical grid. In some implementations according to this disclosure, the one or more criteria are based on other parameters instead of, or in addition to, parameters based on monitoring the electrical grid. For example, the criteria can be based on a temperature of an aquifer, a predicted time until use of a heat exchanger, or a combination of these and/or other parameters. Some implementations according to this disclosure do not include monitoring the electrical grid.

In response to determining that the one or more criteria are satisfied at the first time, water is moved from an aquifer located at a first elevation to a reservoir located at a second elevation (606). The first elevation is lower than the second elevation. Water is moved from the reservoir through a heat exchanger, and heat is transferred using the water (608). For example, the water can be moved through the heat exchanger in response to one or more second criteria being satisfied. Subsequent to moving the water through the heat exchanger, the water is moved into the aquifer (610). For example, the water can be moved into the aquifer in response to one or more third criteria being satisfied.

Some implementations of the subject matter and operations described in this disclosure can be implemented in digital electronic circuitry, or in computer software, firmware, or hardware, including the structures disclosed in this specification and their structural equivalents, or in combinations of one or more of them. For example, in some implementations, the control system 114 can be implemented using digital electronic circuitry, or in computer software, firmware, or hardware, or in combinations of one or more of them. In another example, the process 600 can be implemented, at least in part, using digital electronic circuitry, or in computer software, firmware, or hardware, or in combinations of one or more of them.

Some implementations described in this specification can be implemented as one or more groups or modules of digital electronic circuitry, computer software, firmware, or hardware, or in combinations of one or more of them. Although different modules can be used, each module need not be distinct, and multiple modules can be implemented on the same digital electronic circuitry, computer software, firmware, or hardware, or combination thereof.

Some implementations described in this specification can be implemented as one or more computer programs, i.e., one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD-ROM and DVD-ROM disks. The processor and the memory can be supplemented by, or incorporated in, special purpose logic circuitry.

To provide for interaction with a user, operations can be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A computer system may include a single computing device, or multiple computers that operate in proximity or generally remote from each other and typically interact through a communication network. Examples of communication networks include a local area network ("LAN") and a wide area network ("WAN"), an inter-network (e.g., the Internet), a network including a satellite link, and peer-to-peer networks (e.g., ad hoc peer-to-peer networks). A relationship of client and server may arise by virtue of computer programs running on the respective computers and having a client-server relationship to each other.

Figure 7:
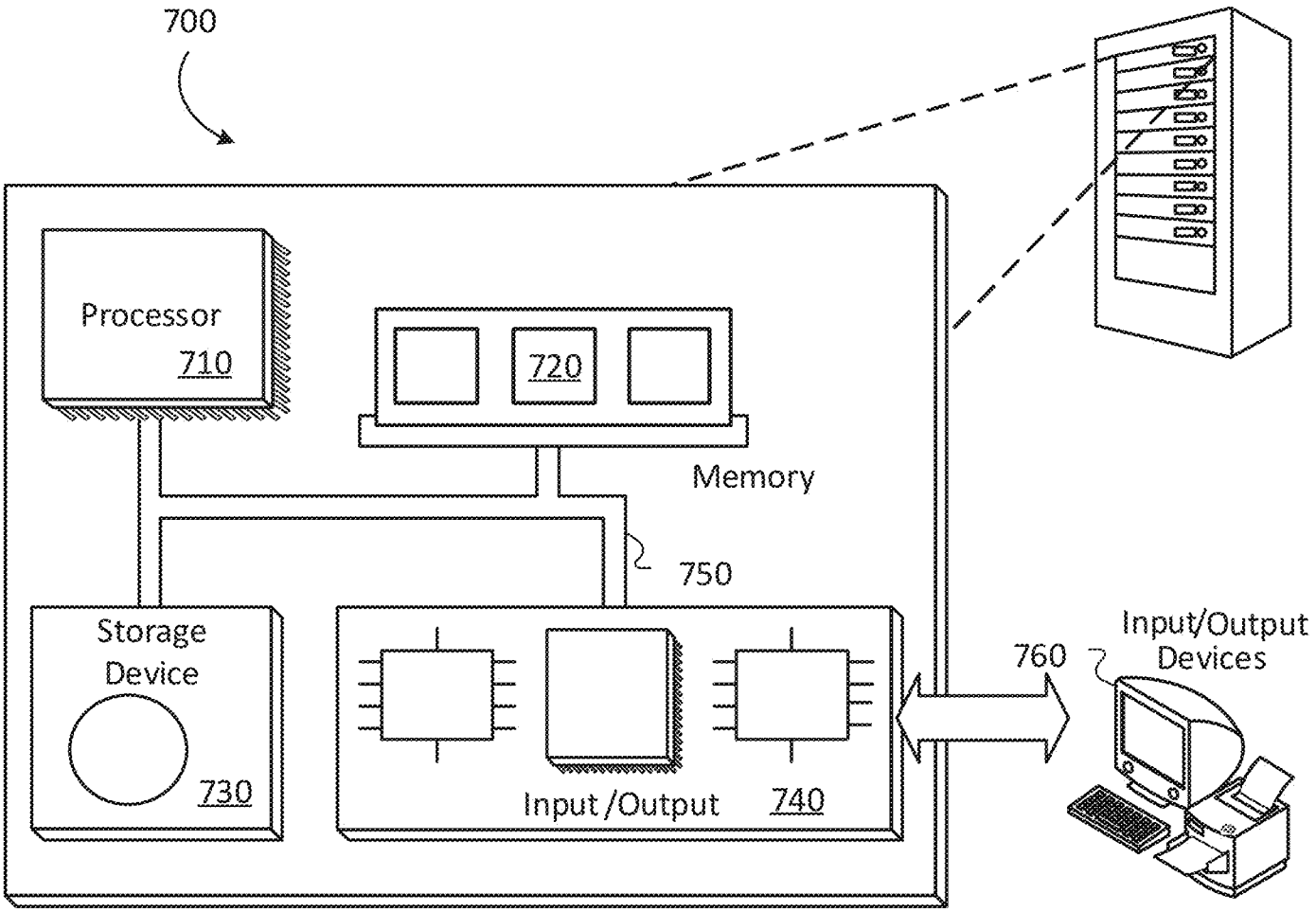
FIG. 7 is a diagram illustrating an example of a computer system.

FIG. 7 shows an example computer system 700 that includes a processor 710, a memory 720, a storage device 730 and an input/output device 740. Each of the components 710, 720, 730 and 740 can be interconnected, for example, by a system bus 750. The processor 710 is capable of processing instructions for execution within the system 700. In some implementations, the processor 710 is a single-threaded processor, a multi-threaded processor, or another type of processor. The processor 710 is capable of processing instructions stored in the memory 720 or on the storage device 730. The memory 720 and the storage device 730 can store information within the system 700.

The input/output device 740 provides input/output operations for the system 700. In some implementations, the input/output device 740 can include one or more of a network interface device, e.g., an Ethernet card, a serial communication device, e.g., an RS-232 port, and/or a wireless interface device, e.g., an 802.11 card, a 3G wireless modem, a 4G wireless modem, a 5G wireless modem, etc. In some implementations, the input/output device can include driver devices configured to receive input data and send output data to other input/output devices, e.g., keyboard, printer and display devices. In some implementations, mobile computing devices, mobile communication devices, and other devices can be used.

While this specification contains many details, these should not be construed as limitations on the scope of what may be claimed, but rather as descriptions of features specific to particular examples. Certain features that are described in this specification in the context of separate implementations also can be combined. Conversely, various features that are described in the context of a single implementation also can be implemented in multiple embodiments separately or in any suitable sub-combination.

A number of implementations have been described. Nevertheless, various modifications may be made without departing from the spirit and scope of the invention. Accordingly, other implementations also are within the scope of the claims.

What is claimed is:

1. A method comprising:

monitoring an electrical grid;

determining, based on monitoring the electrical grid and based on a temperature of an aquifer located at a first elevation, that one or more criteria are satisfied at a first time;

in response to determining that the one or more criteria are satisfied at the first time, moving water from the aquifer to a reservoir located at a second elevation, wherein the first elevation is lower than the second elevation;

moving the water from the reservoir through a heat exchanger, including transferring heat using the water; and subsequent to moving the water through the heat exchanger, moving the water into the aquifer.

2. The method of claim 1, wherein moving the water through the heat exchanger comprises:

determining, based on monitoring the electrical grid, that one or more second criteria are satisfied at a second time; and in response to determining that the one or more second criteria are satisfied at the second time, moving the water from the reservoir through the heat exchanger.

3. The method of claim 1, wherein moving the water into the aquifer comprises:

moving the water to a turbine generator located at a third elevation, wherein the third elevation is lower than the second elevation and higher than the first elevation, generating electrical power using the turbine generator based on the water flowing through the turbine generator, and moving the water from the turbine generator into the aquifer.

4. The method of claim 3, wherein moving the water to the turbine generator comprises:

moving the water from the heat exchanger to a second reservoir;

determining, based on monitoring the electrical grid, that one or more second criteria are satisfied at a second time; and in response to determining that the one or more second criteria are satisfied at the second time, moving the water from the second reservoir to the turbine generator.

5. The method of claim 4, wherein a flow path from the aquifer to the reservoir is separate from a flow path from the second reservoir to the aquifer.

6. The method of claim 3, wherein moving the water to the turbine generator and from the turbine generator into the aquifer comprises moving the water through a conduit under the influence of gravity and without aid of a pump.

7. The method of claim 1, wherein monitoring the electrical grid comprises monitoring a dynamic price of electricity in the electrical grid, and wherein the one or more criteria comprise the dynamic price being below a threshold value.

8. A system comprising:

an aquifer located at a first elevation;

a reservoir located at a second elevation that is higher than the first elevation;

one or more conduits linking the aquifer and the reservoir;

one or more pumps;

a heat exchanger; and a control system having one or more processors, the control system configured to perform operations comprising:

monitoring an electrical grid;

determining, based on monitoring the electrical grid and based on a temperature of the aquifer, that one or more criteria are satisfied at a first time;

in response to determining that the one or more criteria are satisfied at the first time, moving water from the aquifer to the reservoir using the one or more pumps;

moving the water from the reservoir through the heat exchanger, including transferring heat using the water; and subsequent to moving the water through the heat exchanger, moving the water into the aquifer.

9. The system of claim 8, wherein moving the water through the heat exchanger comprises:

determining, based on monitoring the electrical grid, that one or more second criteria are satisfied at a second time; and in response to determining that the one or more second criteria are satisfied at the second time, moving the water from the reservoir through the heat exchanger.

10. The system of claim 8, comprising a turbine generator located at a third elevation, wherein the third elevation is lower than the second elevation and higher than the first elevation, and wherein moving the water into the aquifer comprises:

moving the water to the turbine generator, generating electrical power using the turbine generator based on the water flowing through the turbine generator, and moving the water from the turbine generator into the aquifer.

11. The system of claim 10, comprising a second reservoir, wherein moving the water to the turbine generator comprises:

moving the water from the heat exchanger to the second reservoir;

determining, based on monitoring the electrical grid, that one or more second criteria are satisfied at a second time; and in response to determining that the one or more second criteria are satisfied at the second time, moving the water from the second reservoir to the turbine generator.

12. The system of claim 11, wherein the one or more conduits are one or more first conduits, and further comprising one or more second conduits linking the second reservoir to the turbine generator and the turbine generator to the aquifer, wherein the one or more second conduits are separate from the one or more first conduits.

13. A method comprising:

monitoring an electrical grid;

determining, based on monitoring the electrical grid and based on a predicted time until a heat exchanger will be operated, that one or more criteria are satisfied at a first time;

in response to determining that the one or more criteria are satisfied at the first time, moving water from an aquifer located at a first elevation to a reservoir located at a second elevation, wherein the first elevation is lower than the second elevation;

moving the water from the reservoir through the heat exchanger, including transferring heat using the water; and subsequent to moving the water through the heat exchanger, moving the water into the aquifer.

14. A system comprising:

an aquifer located at a first elevation;

a reservoir located at a second elevation that is higher than the first elevation;

one or more conduits linking the aquifer and the reservoir;

one or more pumps;

a heat exchanger; and a control system having one or more processors, the control system configured to perform operations comprising:

monitoring an electrical grid;

determining, based on monitoring the electrical grid and based on a predicted time until the heat exchanger will be operated, that one or more criteria are satisfied at a first time;

in response to determining that the one or more criteria are satisfied at the first time, moving water from the aquifer to the reservoir using the one or more pumps;

moving the water from the reservoir through the heat exchanger, including transferring heat using the water; and subsequent to moving the water through the heat exchanger, moving the water into the aquifer.

15. A system comprising:

an aquifer located at a first elevation;

a reservoir located at a second elevation that is higher than the first elevation;

one or more conduits linking the aquifer and the reservoir;

one or more pumps;

a heat exchanger; and a control system having one or more processors, the control system configured to perform operations comprising:

monitoring an electrical grid;

determining, based on monitoring the electrical grid, that one or more criteria are satisfied at a first time;

in response to determining that the one or more criteria are satisfied at the first time, moving water from the aquifer to the reservoir using the one or more pumps;

determining, based on monitoring the electrical grid, that one or more second criteria are satisfied at a second time, wherein the one or more second criteria comprise that use of the water in the heat exchanger is more cost-effective than use of an alternative secondary fluid in the heat exchanger or use of an alternative system to perform a heating or cooling function performed by the heat exchanger;

in response to determining that the one or more second criteria are satisfied at the second time, moving the water from the reservoir through the heat exchanger, including transferring heat using the water; and subsequent to moving the water through the heat exchanger, moving the water into the aquifer.

16. The system of claim 15, comprising a turbine generator located at a third elevation, wherein the third elevation is lower than the second elevation and higher than the first elevation, and wherein moving the water into the aquifer comprises:

moving the water to the turbine generator, generating electrical power using the turbine generator based on the water flowing through the turbine generator, and moving the water from the turbine generator into the aquifer.

17. The system of claim 16, comprising a second reservoir, wherein moving the water to the turbine generator comprises:

moving the water from the heat exchanger to the second reservoir; and moving the water from the second reservoir to the turbine generator.

18. A system comprising:

an aquifer located at a first elevation;

a reservoir located at a second elevation that is higher than the first elevation;

one or more conduits linking the aquifer and the reservoir;

one or more pumps;

a heat exchanger; and a control system having one or more processors, the control system configured to perform operations comprising:

monitoring an electrical grid;

determining, based on monitoring the electrical grid, that one or more criteria are satisfied at a first time;

in response to determining that the one or more criteria are satisfied at the first time, moving water from the aquifer to the reservoir using the one or more pumps;

monitoring an ambient temperature at the earth's surface;

determining, based on monitoring the ambient temperature, that one or more second criteria are satisfied at a second time;

in response to determining that the one or more second criteria are satisfied at the second time, moving the water from the reservoir through the heat exchanger, including transferring heat using the water; and subsequent to moving the water through the heat exchanger, moving the water into the aquifer.

19. The system of claim 18, wherein determining that the one or more second criteria are satisfied is based on monitoring the electrical grid.

20. The system of claim 18, comprising a turbine generator located at a third elevation, wherein the third elevation is lower than the second elevation and higher than the first elevation, and wherein moving the water into the aquifer comprises:

moving the water to the turbine generator, generating electrical power using the turbine generator based on the water flowing through the turbine generator, and moving the water from the turbine generator into the aquifer.

* * * * *